United States Patent [19]

Tojza

[11] 4,447,058

[45] May 8, 1984

[54] GAME GATE DEVICE

[75] Inventor: Roman A. Tojza, Chicago, Ill.

[73] Assignee: Bally Manufacturing Corporation, Chicago, Ill.

[21] Appl. No.: 262,227

[22] Filed: May 11, 1981

[51] Int. Cl.[3] ..... A63D 3/00; A63D 3/02

[52] U.S. Cl. ..... 273/121 A; 273/118 A

[58] Field of Search ..... 273/111, 118 A, 119 A, 273/119 R, 121 A, 121 R, 122 A, 122 R, 123 A, 123 R, 124 A, 124 R, 125 A, 125 R, 129 V, 42 A; 74/104

[56] References Cited

U.S. PATENT DOCUMENTS

| | | | |
|---|---|---|---|
| 2,364,897 | 12/1944 | Grigsby | 273/42 A |
| 2,642,290 | 6/1953 | Moloney et al. | 273/118 |
| 3,196,700 | 7/1965 | Gron | 74/104 |
| 3,298,691 | 1/1967 | Berninger et al. | 273/129 R |
| 3,404,888 | 10/1968 | Lally et al. | 273/121 A |

*Primary Examiner*—Richard J. Apley
*Assistant Examiner*—S. R. Crow
*Attorney, Agent, or Firm*—Welsh & Katz, Ltd.

[57] ABSTRACT

A game gate device having a variable width passageway for passage of a game ball. The gate device is pivotable for variable passageway spacing between a wide open and a narrow open position, wherein the spacing in both the wide open and narrow open positions are both sufficient to allow passage of the game ball through the gate device. In the preferred embodiment, the gate device is for use in a game having a ball and a downward sloping playfield having an upper and lower portion, the gate device being positioned between the upper and lower portions of the playfield. The gate device is comprised of first and second arms in spaced relationship with one another and aligned lengthwise extending down the playfield, the arms being pivotable at one end between a first and a second position for selectively providing the variable width passageway at the other end of the arms. The relative difficulty of passing the ball through the passageway is determined by the arm positions in either the first or second position.

9 Claims, 6 Drawing Figures

GAME GATE DEVICE

BACKGROUND OF THE INVENTION

This invention relates to amusement game machines having a ball and a playfield, such as pinball or other surface-projectile game machines, and more particularly to a gate device, for such a game, having a variable width passageway for passage of the game ball.

Heretofore, amusement machines have utilize gate members which allow passage of the game ball when in the open position, and which block passage of the game ball in a closed position. Thus, the game options consisted of either passage of the game ball through the gate in the open position, or complete blockage of passage of the ball through the gate in a closed position. A conventional mechanism used in many pinball games consists of flipper paddles responsive to player actuation for selectively striking the ball upward to keep the ball in play and preventing the ball from leaving the bottom of the playfield. However, the flipper paddles provide propulsion means, rather than gating means, and do not address the subject matter of the present invention.

The present invention provides for a gate device pivotable for variable passageway spacing between a wide open and a narrow open position, wherein the spacing in both the wide open and narrow open positions are sufficient to allow passage of the game ball through the gate device to a score incrementing target or the like. These features provide the advantage of providing game play of various complexity levels by selectively providing either wide or narrow gate device openings for passage of said ball.

The novel features believed characteristic of the present invention are set forth in the appended claims. However, the above advantages and features, as well as others, may be more readily understood by reference to the drawings and accompanying detailed description, wherein:

Figure 1:
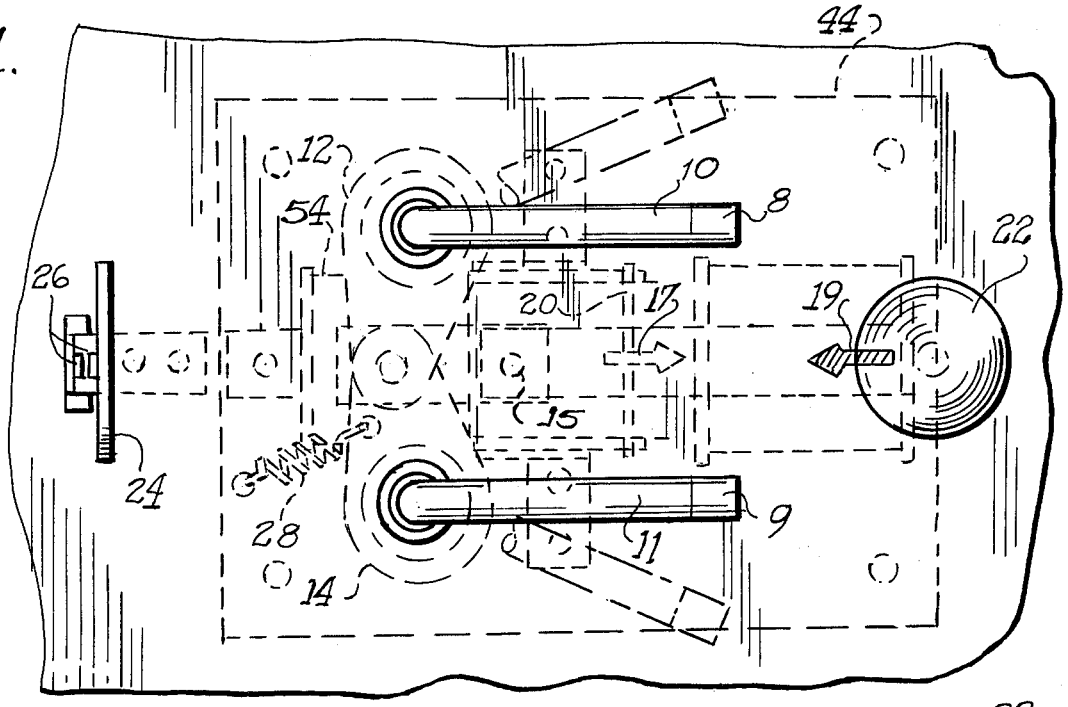
FIG. 1 is a top plan view of a preferred embodiment of a game gate device of the present invention.

In accordance with the above, the present embodiment of the invention broadly includes an apparatus for use in a surface-projectile game having a ball and a sloping playfield having an upper and a lower portion. The apparatus is comprised of a gating means comprising first and second arms in spaced relationship with one another and aligned lengthwise extending down the playfield. The arms are pivotable at one end portion between a first and a second position for selectively providing variable width passage through which the ball may pass from the lower to the upper portion of the playfield. A score incrementing target or the like may be disposed in proximity to the gating means so as to be responsive to the ball passing therethrough and actuated by contact with the ball. The apparatus may be better understood by reference to FIG. 1 and the accompanying description.

The relative ease of movement of the ball between the first and second arms is generally proportional to the width of the variable width passage. Thus, the wider the passage through which the ball may pass, the easier it becomes to pass the ball from the lower to the upper portion of the playfield. In a preferred embodiment, the game is structured so that the player benefits from passing the ball through the passage to the upper portion of the playfield.

In the preferred embodiment, the arms act as guides to pass the ball from the variable width portion at the bottom of the arms through the passage and through the fixed width portion at the top of the arms.

The first position provides a relatively wide opening between the bottom of the arms and the second position provides a relatively narrow opening between the bottom of the arms, where both the first and the second position openings are spaced to allow passage of the ball through the opening. Only the relative difficulty of passing the ball through the passage between the first and second arms is affected and determined by the arm positions in either the first or second position. This provides for controlled game-play-complexity levels.

The apparatus is further characterized in that the gating means selectively pivots the arms to the first position responsive to a first stimulus, and to the second position responsive to a second stimulus. The first and second stimuli are, in the preferred embodiment, provided by a game control circuit responsive to the movement of the ball on the playfield and the points and targets struck by the ball during play, and are thus not directly controllable by the user of the game (player). In an alternate embodiment, means may be provided for allowing limited or full control of the positions of the arms responsive to user stimulus.

The gating means is further comprised of first and second links coupled to the first and second arms, respectively, the links being mounted at a common point for pivotable motion. The links may be better understood by reference to FIGS. 1, 5 and 6 and the accompanying description. A drive arm is coupled to the first and second links at the common point, mounted for movement along a fixed path, and a drive means is mounted to the drive arm for selectively moving the drive arm in the first direction responsive to a first stimulus. (The drive means and drive arm are shown and discussed with reference to FIGS. 1, 2, 3 and 4.) Movement of the drive arm along the fixed path, a linear path in the preferred embodiment, causes coincidental movement of the first and the second links at the common point, thereby pivoting the first and second links about the common point, thus pivoting the first and the second arms in coincidence with the pivoting of the first and the second links.

In operation, movement of the drive arm 16 in the first direction positions a notch on the underside of the drive arm, atop a latch pin, thereby engaging the latch pin and the notch in an overlying construction, and locking the drive arm, and correspondingly the first and the second arms, in the first position. In the preferred embodiment, the drive means is a solenoid, and the drive arm is a solenoid arm. However, other means may be utilized as the drive means, such as pneumatic, mechanical, or other electrical means.

A biasing means resists movement of the drive arm in the first direction, and resiliently urges movment in a second direction.

Disengagement of the engaging member results in the drive arm moving in the second direction responsive to the biasing means, thereby engaging movement of the links so as to move the arms to the second position.

Upon disengagement of the latching member, the biasing means exerts a force in the second direction on the drive arm, back to the initial or rest position, thereby moving the first and second arms to the initial position.

In the illustrated embodiment, the apparatus is further comprised of a stop, positioned to limit the pivotable motion of said first and second links beyond a predefined stop position. The stop prevents backlash movement of the first and second arms.

The apparatus in the illustrated embodiment, is further characterized in that distance of the arms above the playfield is less than the fixed diameter of the ball. Thus, the ball cannot pass under (or over) the portions of the arms atop the playfield, but must instead move through the passageway between the arms.

The apparatus in the illustrated embodiment is further characterized in that the playfield is divided into first and second portions, and the arms are positioned in part above the playfield to pass the ball between the arms from the first portion to the second portion of the playfield. The game may be so arranged that it is to the player's advantage to pass the ball between the arms from the first portion to the second portion, such as to strike a target or the like. However, since the most open position of the arms provides a wider entry portion of the passageway than does the less open position of the arms, game play, of course, is easier when the arms are in the most open position. Thus, the level of difficulty of game play may be varied under game control (such as based upon previous game play up to that point in time).

The apparatus in the illustrated embodiment, is further characterized in that the arms and the ball are composed of low resiliency material. Thus, the propulsion of the ball into the arms will primarily result in redirection of the ball along the arms, rather than rebound of the ball off the arms.

Referring to FIG. 1, a plan view of the gate device of the present embodiment of the invention is shown, comprising movable arms 10 and 11 having bumper tips 8 and 9 mounted on one end of the arms 10 and 11, respectively, the one end being the swing end of the arms 10 and 11. In the preferred embodiment, the bumper tips 8 and 9 are formed from rubber. However, the bumper tips 8 and 9 may be comprised of steel, plastic, or may form an integral part of the arms 10 and 11. The arms 10 and 11 are mounted to links 12 and 14, respectively, the links 12 and 14 controlling the movement of the arms. The links 12 and 14 are shown in greater detail in FIGS. 5 and 6, as will be described hereinafter.

The links 12 and 14 are pivotably connected to to a solenoid arm 16 at a common point such that movement of the solenoid arm 16 controls movement of the links 12 and 14 thereby controlling movement of the arms 10 and 11, respectively. A spring 28 is mounted to the link 14 and is also mounted to a stationary plate 44.

The spring 28 resiliently resists movement of the link 14 by the solenod arm 16 in a first direction as indicated by the arrow 17. The links 12 and 14 are biased against a stop 54 which limits the movement of the links 12 and 14 in conjunction with control arms 36 and 38 as explained hereinafter with reference to FIG. 2 (and as shown in greater detail in FIG. 6).

FIG. 1 shows a plan view of a portion of a game playfield 48, the portion containing the gate device. The plate 44 is mounted to the underside of the playfield 48 (as seen in greater detail with reference to FIG. 2), and a lower portion of the arms 10 and 11 extend upward through the playfield 48 and upward above the playfield, with an upward portion of the arms being positioned above and parallel to the playfield, in spaced relation with each other. Additionally, in the preferred embodiment, the upper portion of the arms 10 and 11 are at a parallel uniform height to each other.

The gate device operates in a manner such that prior to activation of the solenoid arm 16 in the direction 17, the arms 10 and 11 are in a narrow open position as shown by the solid line arms denoted 10 and 11. The narrow open position allows a game ball 22 to pass between the spaced opening between the upward portion of the arms 10 and 11, enabling the game ball 22 to strike a target 24 thereby closing contacts 26, whereby, for example, a hit on the target yields points to increase the players score or changes the position of the arms. The target 24 may be comprised of any sort of pressure sensitive or proximity sensing means, such as a lever switch, or a capacitive or magnetic proximity sensor. In addition, where the ball 22 has metal properties, the target 24 may be comprised of a metal or conductivity sensing device. When the solenoid arm 16 moves in the (first) direction 17, the links 12 and 14 coupled to the solenoid arm 16 are moved at the common pivot point of connection, thereby moving the arms 10 and 11 to the dot-dash line wide open position. The game ball 22 is provided a wider path opening through which it may pass through the gate device, thereby providing for easier passage of the ball through the gate device in the wide-open position. This results in a correspondingly easier game play setup for the player. In the preferred embodiment, the arms 10 and 11 are comprised of a hard material, such as steel, and propulsion of the ball 22 in the direction 19 so as to strike the arms 10 or 11 will cause the ball 22 to be directed into the opening between the arms, passing therebetween and beyond so as to reach the upper area of the playfield beyond the gating device, and allowing the ball 22 to strike the target 24. It is, of course, much easier for the ball to pass through the gate device to enter the upper area of the playfield when the gate device is in the wide open position thereby providing a relatively wide target area for the ball 22 to pass through.

Figure 2:
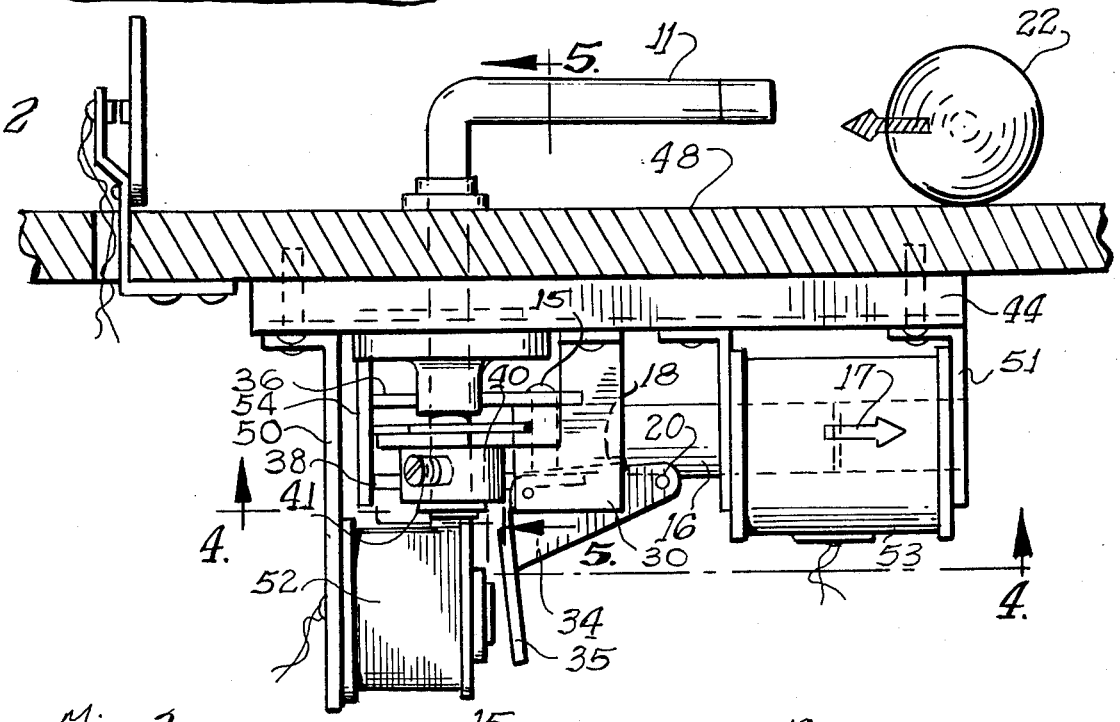
FIG. 2 is a side view of the game gate device as shown in FIG. 1.

Referring to FIG. 2, it is seen that the arm 11 (and also in a similar manner the arm 10 not visible in FIG. 2) is comprised of an L-shaped member having an upper arm and a lower arm, the upper arm being positioned above and approximately parallel to the playing field 48, spaced apart from the playing field 48 at a distance less than the diameter of the game ball 22. The lower arm of the L-shaped member arm 11 (and the arm 10 not shown in FIG. 2) extends downward through an opening in the playing field, and through an opening in the plate 44, coupling to the link 14, secured to the link 14 by the hub 40. The coupling arrangement of the hub 40, the link 14, and the solenoid arm 16, is shown and described in greater detail with reference to FIGS. 5 and 6. Control arms 36 and 38 secure the links 12 and 14, respectively, to the solenoid arms 16, as may be seen in greater detail with reference to FIGS. 5 and 6. A latching device 34, secured by brackets 30 and 32 (as shown in greater detail in FIG. 4), is pivotably mounted such that its normal rest position is as shown in FIG. 2. A latch pin 20 is mounted to one end of the latching device 34. The latch pin 20 is positioned underneath the control arm 16 in juxtaposition therewith when said latching device 34 is in the rest position. The control arm 16 has a notch 18 formed in the underside thereof. The solenoid arm 16 is mounted to a solenoid 53, the solenoid 53 being mounted to the plate 44. Energization of the solenoid 53 engages the solenoid arm 16 so as to move the arm 16 in the first direction 17, causing the notch 18 to move with the solenoid arm 16 so as to engage the latch pin 20.

Figure 3:
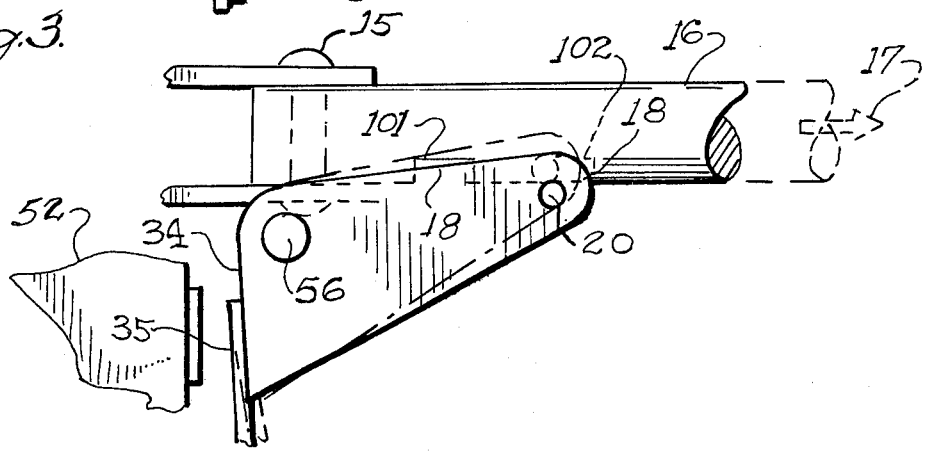
FIG. 3 is an enlarged view of the latching mechanism solenoid of FIG. 1 illustrating the latching interaction of latch pin and notch with movement shown in dot-dash.

Referring to FIG. 3, movement of the solenoid arm 16 in the first direction 17 moves the notch 18 from a first position 101 to a second position 102, the notch 18 engaging the latch pin 20 by over-center construction at position 102. When the latch pin 20 engages the notch 18, the solenoid arm 16 is locked in position, such that the arms 10 and 11 are held in the wide open position even after de-energization of the solenoid 53. The latching member 34 is additionally comprised of a downwardly extending (metal in the preferred embodiment) member 35 and is constructed for receiving a pin 56, the pin 56 forming a pivot point for the latching member 34.

Referring again to FIG. 2, the gate device is further comprised of an electromagnet 52 mounted to the plate 44. In response to a second stimulus, the electromagnet 52 is energized, thereby magnetically attracting the member 35 towards the electromagnet 52, thereby disengaging the pin 20 from the solenoid arm 16, such that the solenoid arm 16 is moved in a second direction opposite that of direction 17 responsive to the force exerted by the spring 28 on the link 14, thereby returning the arms 10 and 11 to the narrow open position. Upon de-energization of the electromagnet 52, the latching device 34 returns to its rest position. The member 35 of the latching device 34 and the electromagnet 52 may be replaced by any means for selectively lowering the pin 20 from the notch 18, such as a solenoid and arm coupled to the latching device 34 so as to move the latching device 34 in a manner so as to disengage the pin 20 from the notch 18 when the solenoid is energized. An advantage of the present invention construction is that the wide open and the narrow open position of the arms 10 and 11 are maintained with only momentary energization of the solenoid 53 and the electromagnet 52, thereby conserving power and extending the useful life of the solenoid 53 and the electromagnet 52.

A set screw 41 is located in the hub 40 to allow for set-up positioning of the arm 11 in a preferred position. A similar set screw is provided in the hub 42 for positioning of the arm 10. Thus, the spaced relationship of the arms 10 and 11 may be adjusted via the set screws in hubs 40 and 42 and then locked in the desired position via the set screws. Also, the plate 44, in the preferred embodiment, has extension plates 50 and 51 for mounting of the electromagnet and the solenoid, 52 and 53, respectively.

Figure 4:
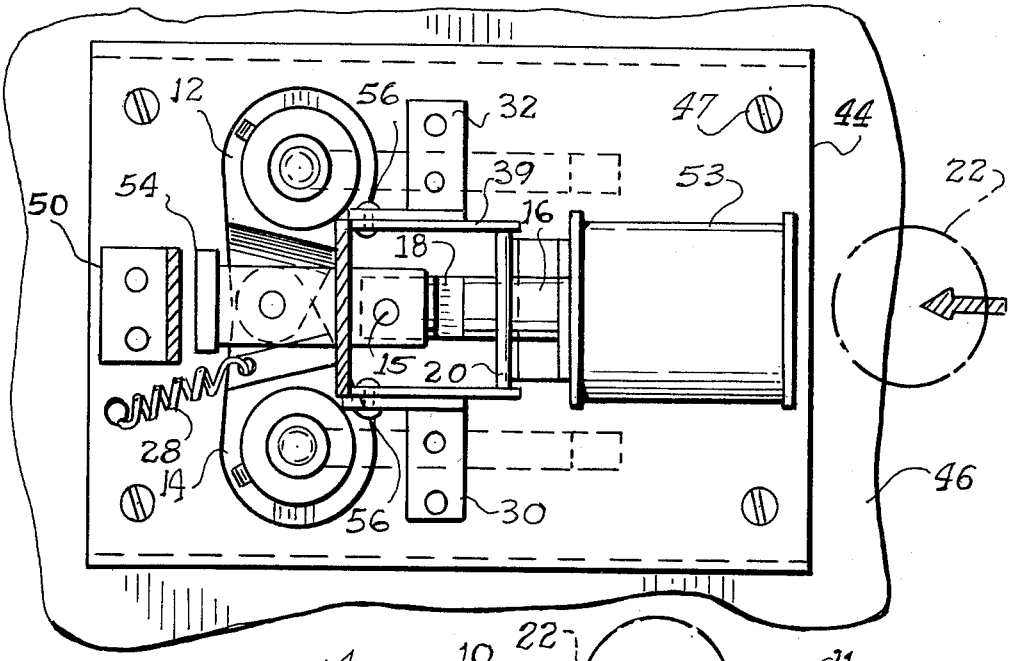
FIG. 4 is a bottom view, partially in section, taken on line 4—4 of FIG. 2 of the preferred embodiment.

Referring to FIG. 4, the coupling and interaction of the links 12 and 14, the solenoid arm 16, the notch 18, the latch pin 20, latching device 34, and stop 54, may be better understood. Additionally, the connection and mounting of the spring 28, and the mounting of the latching device 34 to the brackets 30 and 32 via the pins 56 may be seen in greater detail. The plate 44 is mounted to the underside 46 of the playfield 48 (not shown in FIG. 4) by screws 47 or other appropriate mounting means, which, may for example include bolts, adhesive, or other mounting means. The brackets 30 and 32 are mounted to the plate 44. The pin 56 mounts through the brackets 30 and 32 to the latching device 34, thereby providing a pivotable mounting of the latching device.

Figure 5:
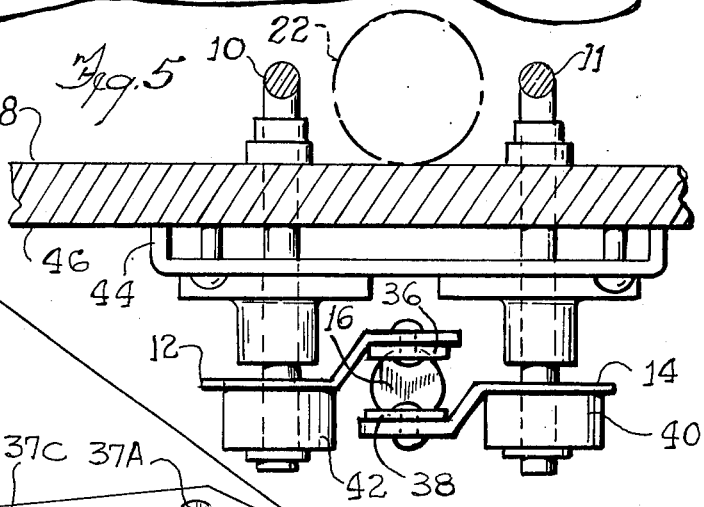
FIG. 5 is a sectional view, taken on line 5—5 of FIG. 2, showing the mounting mechanism for arms of FIGS. 1 and 2.

Referring to FIG. 5, the interaction and coupling of the arms 10 and 11, the links 12 and 14, and the solenoid arm 16 may be more clearly seen. The hubs 42 and 40 secure links 12 and 14, respectively, to the downwardly extending portions of the arms 10 and 11, respectively. The links 12 and 14 are connected to control arms 36 and 38, respectively, as shown in greater detail in FIG. 6. The control arms 36 and 38 are also connected to the solenoid arm 16 by connecting pin 15. The control arms 36 and 38 form an extension of the solenoid arm 16, and control the over center movement of the links 12 and 14. Additionally, the control arms 36 and 38 limit the rearward movement of the links 12 and 14 as urged by the spring 28, in conjunction with the stop 54. The control arms 36 and 38 will strike the stop 54 when rearward movement of the links 12 and 14, and thus rearward movement of the control arms 36 and 38, extend beyond a predetermined point (as defined by the stop 54). This interaction of the control arms 36 and 38 and the stop 54 may be better understood by referencing FIGS. 4 and 5 together.

Figure 6:
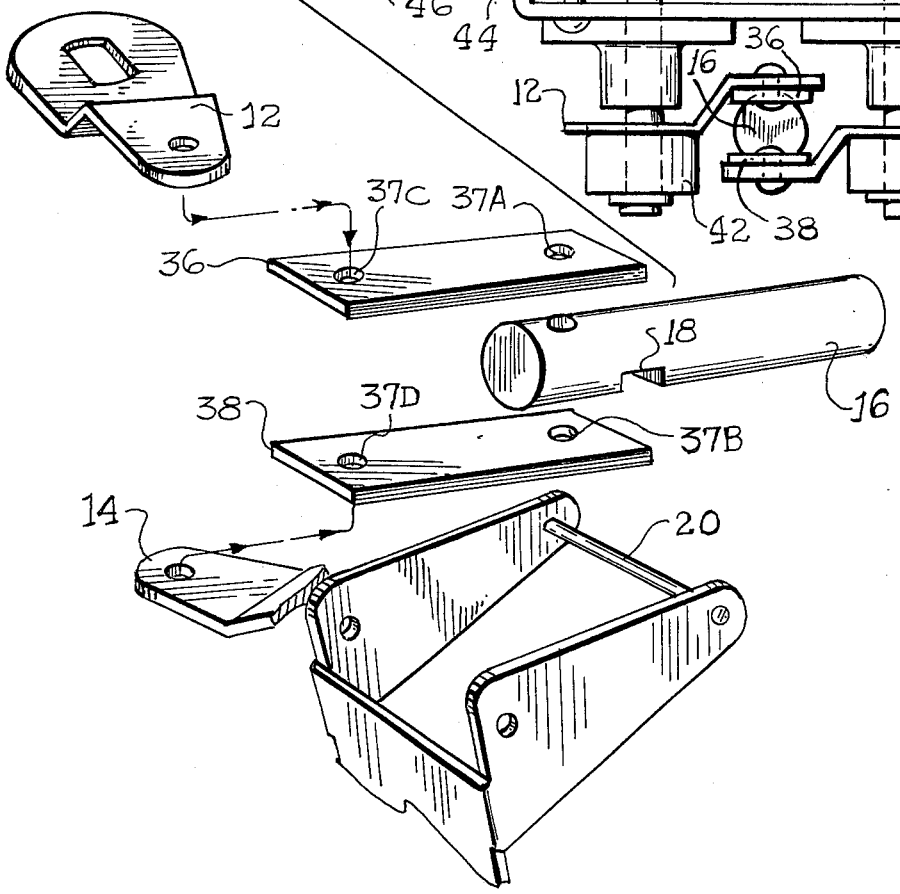
FIG. 6 is an exploded perspective view of the mechanism by which the movement of links is controlled.

Referring to FIG. 6, the interconnection and relative positioning of the links 12 and 14, the control arms 36 and 38, the solenoid arm 16, and the latching device 34 are presented in exploded perspective view. In the preferred embodiment, the control arms 36 and 38 are mounted in parallel spaced alignment to the solenoid arm 16 with the pin 15 (as shown in FIG. 5) extending through parallel holes **37*a* and 37*b* in the control arms 36 and 38 respectively. The link 12 is mounted atop and connected to the control arm 36 via the hole 37*c* in control arm 36, while the link 14 is mounted beneath and connected to the control arm 38 via the hole 37*d* in the control arm 38, the holes 37a and 37b being in parallel alignment 12 and 14 pivot about a common point. In the preferred embodiment, each of the links 12 and 14 is pivotally connected to its corresponding control arm 36 and 38** via a pin not shown.

Although the invention has been described with reference to specific embodiments, this description is not meant to be construed in a limiting sense. Various modifications of the disclosed embodiment, as well as other embodiments of the invention, will become apparent to persons skilled in the art upon reference to the description of the invention. It is, therefore, contemplated that the appended claims will cover any such modifications or embodiments as fall within the true scope of the invention.

What is claimed is:

1. In a ball-rolling game having a downwardly sloping playfield defining an upper end and a lower end and enabling a game ball to be projected upwardly on the playfield, the combination therewith comprising gating apparatus including a pair of generally L-shaped gate members having first arm portions extending downwardly through said playfield in substantially parallel relation, means supporting said first arm portions for rotational movement about their longitudinal axes, said first arm portions extending above said playfield and being spaced apart a distance slightly greater than the diameter of a game ball so as to define a game ball passage therebetween, said gate members having generally coplanar second arm portions disposed above said playfield in substantially parallel spaced relation thereto and being directed generally toward the lower end of the playfield, a control link fixedly secured in radial relation to each of said first arm portions below said playfield, a pair of discrete control arms each of which is pivotally connected directly to a corresponding one of said control links, an actuator shaft supported below said playfield so that the axis of said shaft is substantially normal to a plane containing the axes of said first arm portions of said gate members, means pivotally connecting each of said control arms to said actuator shaft so as to define a common pivot axis therebetween, and actuator means operatively associated with said actuator shaft for effecting selective rectilinear movement thereof between first and second positions in response to command signals so as to effect selective rotation of said second arm portions of said gate members between first substantially parallel positions defining a generally parallel walled ball guide path therebetween and second diverging positions defining a converging guide path toward said game ball passage, whereby the difficulty of projecting a game ball through said game ball passage from the lower end of said playfield is increased when said second arm portions are in their said first positions.

2. A ball-rolling game as defined in claim 1 including a latch member pivotally supported beneath said playfield for movement between first and second positions, said latch member and said actuator shaft having mutually cooperable latching means operative to releasably latch said second arm portions to said gate members in their second positions.

3. A ball-rolling game as defined in claim 2 including means for effecting pivotal movement of said latch member so as to disengage said latching member from said actuator shaft in response to a command signal.

4. A ball-rolling game as defined in claim 3 wherein said mutually cooperable latching means includes a latching pin carried by said latch member and a notch formed in said actuator shaft and cooperable with said latch pin to maintain said actuator shaft in a position wherein said second arm portions of said gate members are disposed in their said diverging positions.

5. A ball-rolling game as defined in claim 1 including biasing means for resiliently urging said actuator shaft in a direction wherein said second arm portions of said gate members are disposed in their said first positions.

6. A ball-rolling game as defined in claim 2 wherein said latch member is biased to a latching position with said actuator shaft, and including electromagnet means operatively associated with said latch member and operative to release said latch member from its said latching relation with said actuator shaft in response to a command stimulus.

7. A ball-rolling game as defined in claim 1 including a target supported by said playfield between said upper end thereof and said gating apparatus, said target being adapted for engagement by a game ball after passing through said game ball passage.

8. A ball-rolling game as defined in claim 1 including stop means mounted on said playfield and cooperative with said control arms so as to establish said first positions of said gate members.

9. A ball-rolling game as defined in claim 1 wherein said actuator means selectively pivots said arms to their said first positions responsive to a first stimulus, and said actuator means selectively pivots said arms to their said second positions responsive to a second stimulus.

* * * * *